US005642786A

United States Patent [19]

Puttmann et al.

[11] Patent Number: 5,642,786

[45] Date of Patent: Jul. 1, 1997

[54] SECURING AND TENSIONING DEVICE FOR A TOWING CABLE CONNECTED TO A PERCUSSION BORING MACHINE

[75] Inventors: Franz-Josef Puttmann; Alfons Hesse, both of Lennestadt, Germany

[73] Assignee: Tracto-Technik Paul Schmidt Spezialmaschinen KG, Lennestadt, Germany

[21] Appl. No.: 508,663

[22] Filed: Jul. 28, 1995

[30] Foreign Application Priority Data

Jul. 30, 1994 [DE] Germany ..... 44 27 119.8

[51] Int. Cl.[6] ..... E21B 11/02

[52] U.S. Cl. ..... 175/171; 173/32

[58] Field of Search ..... 175/19, 171; 405/154, 405/184; 173/32

[56] References Cited

U.S. PATENT DOCUMENTS 4,100,972 7/1978 Schmidt ..... 175/171 X 4,840,234 6/1989 Schmidt .

FOREIGN PATENT DOCUMENTS 510561 3/1980 Austria .

689873 3/1930 France .

1542541 3/1979 United Kingdom .

2126267 9/1982 United Kingdom .

*Primary Examiner*—William P. Neuder

*Attorney, Agent, or Firm*—Bell, Seltzer, Park & Gibson, P.A.

[57] ABSTRACT

A securing and tensioning device for a towing cable that is secured to a percussion boring machine and connects a pipe that is to be pulled in to the boring machine, comprising a thrust member bearing on the free end of the pipe that is to be pulled in, a clamping unit that is adjacent to the thrust member and clamps when a force acts on the towing cable in the direction of the pipe that is to be pulled in, and a tensioning unit arranged coaxially with the clamping unit that clamps when a force acts in the direction of the pipe that is to be pulled in and is movable in the direction opposite to that of the pipe that is to be pulled in.

15 Claims, 3 Drawing Sheets

SECURING AND TENSIONING DEVICE FOR A TOWING CABLE CONNECTED TO A PERCUSSION BORING MACHINE

TECHNICAL FIELD OF THE INVENTION

The invention relates to a device for securing and tensioning a towing cable that is secured to a percussion boring machine and connects a pipe to be pulled in to the percussion boring machine.

BACKGROUND OF THE INVENTION AND PRIOR ART

Such securing and tensioning devices are required in order to enable a pipe that is to be introduced into a bore in the ground to be pulled behind a percussion boring machine that is forming the bore when it is not possible to join the pipe to the boring machine in a tension-proof manner. In a known securing and tensioning device of this kind one end of the towing cable is secured in a sleeve that is joined to the boring machine in a tension-proof manner and is passed through a towed pipe inserted into the sleeve. On the free end of the towed pipe is placed a thrust member having a displaceable device for clamping the cable. The clamping device comprises clamping jaws that can be tightened up by means of screws and are axially displaceable in a guide. Engaging with this guide there is a tensioning screw that is connected to the clamping jaws, by means of which the clamping jaws can be displaced axially.

This clamping and tensioning device is awkward to manipulate, since the clamping jaws must first be brought as close as possible to the thrust member by turning the tensioning screw, and the manually tensioned cable must then be clamped between the clamping jaws by tightening up the clamping screws, whereafter tensioning of the towing cable by turning the tensioning screw is possible. Furthermore, the length of the tensioning stroke is limited, so that it is not possible either to take account of the greater amount of stretching that occurs in the case of very long towed pipes or to re-tension if loosening occurs.

OBJECT OF THE INVENTION

It is an object of the invention to provide a securing and tensioning device that is simple to manipulate, has an unrestricted tensioning stroke, and makes simple retensioning possible.

SUMMARY OF THE INVENTION

To this end the invention consists in a securing and tensioning device of the kind referred to which comprises a clamping unit that is adjacent to the thrust member and clamps when a force acts on the towing cable in the direction of the pipe being pulled in, and a tensioning unit arranged coaxially with the clamping unit that clamps when a force acts in the direction of the pipe being pulled in and is movable in the direction opposite to that of the pipe being pulled in.

The clamping unit and the tensioning unit act automatically to clamp when a force acting in the direction of the pipe to be pulled in occurs, while the clamping unit and the tensioning unit release the towing cable if a movement in the opposite direction takes place. In this manner it is possible to tension the towing cable by means of the tensioning unit through a forward and backward movement, the clamping unit holding the towing cable fast during each forward movement of the tensioning unit and thus enabling the tensioning unit to grasp a portion of the cable and again tension it during the backward movement.

Since no screws have to be operated on the clamping unit or on the tensioning unit for clamping or tensioning, manipulation is extremely simple and re-tensioning can be performed at any time.

The clamping unit can have parallel clamping jaws guided on parallel links, and the parallel links can be pivoted on an extension of the thrust member. By the pull of the towing cable the clamping jaws on the parallel links are pulled towards the thrust member and thereby clamp the towing cable. In the opposite direction the clamping jaws move apart and release the towing cable.

A simple release of the towing cable clamped between the clamping jaws can be achieved by means of a lever extension arranged on one of the parallel links.

In order to obtain automatic clamping of the towing cable in all circumstances, the clamping unit can be urged in the clamping direction by means of a spring.

The tensioning unit can also have similarly constructed and likewise parallel clamping jaws guided on parallel links. The parallel links are pivoted on a further pair of links which are pivoted at one end on the extension of the thrust member and at the other end are connected together through a further link and have a handle for tensioning the follower pipe. This handle can consist of a lever extension on the link connecting the pair of links.

Since the handle engages with the pair of links, the clamping jaws and consequently the towing cable clamped by the clamping jaws can be moved in the tensioning direction, the clamping jaws of the clamping device releasing the towing cable during this movement. If the tensioning unit is moved counter to the tensioning direction, the clamping jaws of the clamping unit hold the towing cable fast, while the clamping jaws of the tensioning unit can slide along the cable in order to clamp a new portion of the cable for further tensioning.

In order to connect the towing cable to the securing and tensioning device in a simple manner, the thrust member can be provided with a side opening for introduction of the towing cable, while the clamping jaws are guided on the parallel links at one side and are thus accessible from the same side as that on which the lateral opening on the thrust member is located.

To secure the towing cable to the percussion boring machine and to receive one end of the pipe to be pulled in, a sleeve can be provided at the end of the boring machine. The sleeve or the boring machine has a cable groove running round it and having an opening leading into the interior of the sleeve. The towing cable can then pass through the pipe to be pulled in and the sleeve, through the opening, lie in the cable groove, and pass back again through the opening into the interior of the sleeve. Here the free end of the cable is firmly connected to the cable pull. A spring serving to tighten the loop of cable lying in the groove can be fitted around parallel regions of the cable between the opening and the tension-proof connection.

BRIEF DESCRIPTION OF THE DRAWINGS

The invention will now be described in more detail, by way of example, with reference to an embodiment shown in the drawings, in which.

DETAILED DESCRIPTION OF PREFERRED EMBODIMENTS OF THE INVENTION

Figure 1:
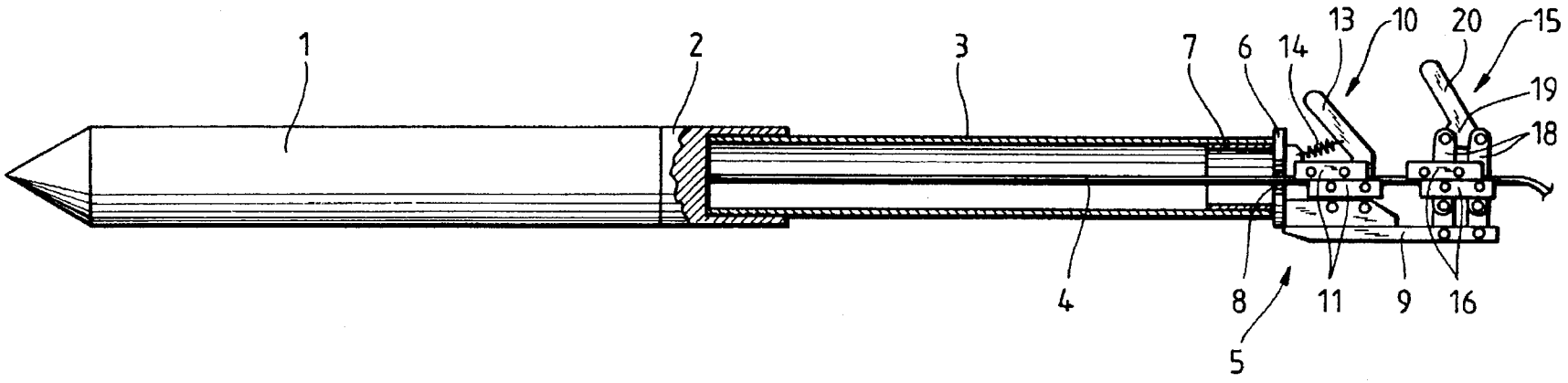
FIG. 1 is a side view of a percussion boring machine having a towed pipe and a securing and tensioning device for a towing cable.
Figure 2:
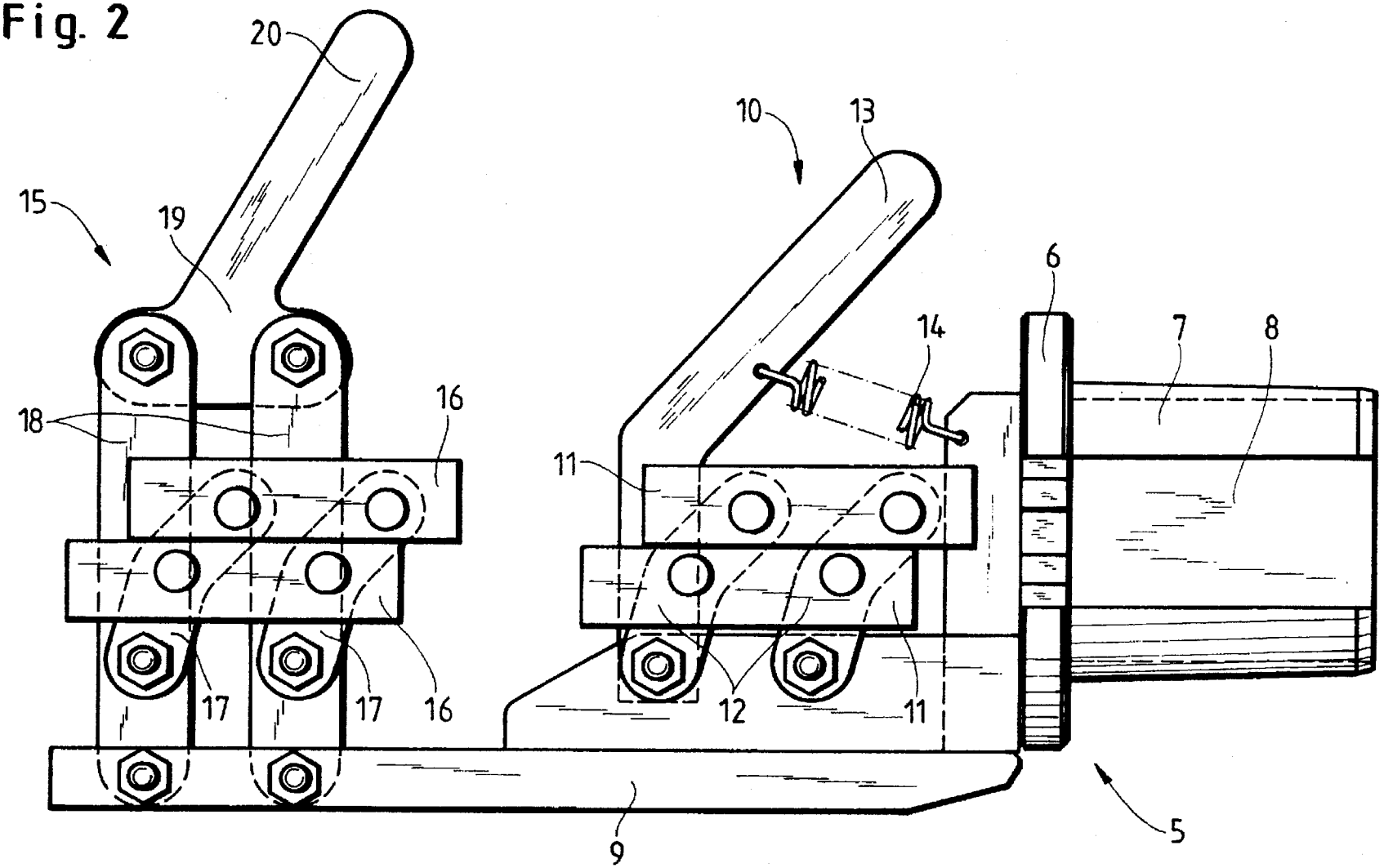
FIG. 2 shows the securing and tensioning device on a larger scale.
Figure 3:
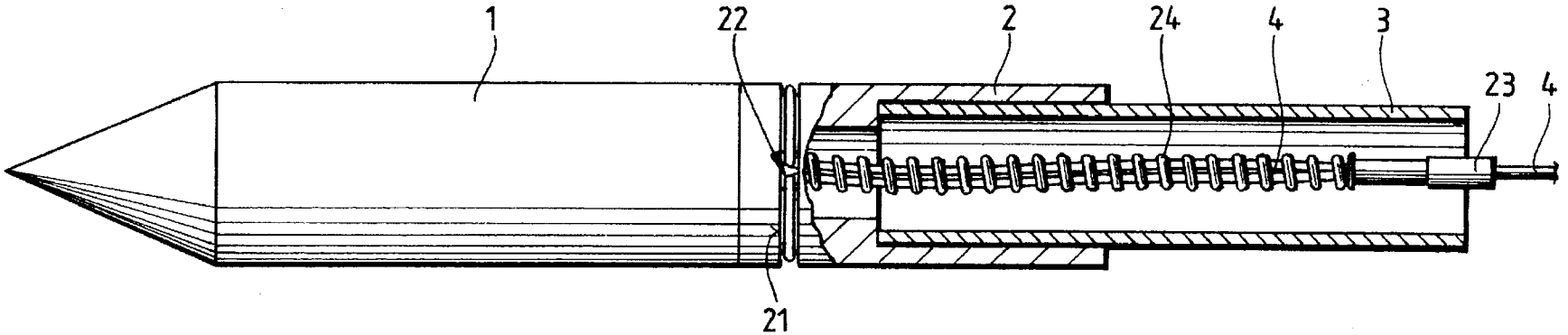
FIG. 3 shows, partly in section, the use of the towing cable with the percussion boring machine.

At the rear end of a percussion boring machine 1 there is a sleeve 2 into which a pipe 3 that is to be pulled in is inserted. A towing cable 4 is passed through the pipe 3 that is to be pulled in, is connected to the percussion boring machine 1 and the sleeve 2, and can be tensioned by means of a clamping and tensioning device. For this purpose a thrust member 5 is fitted at the rear end of the pipe 3 that is to be pulled in, this thrust member comprising a thrust plate 6 bearing on the end of the pipe and a pipe stub 7 introduced into the pipe end. The thrust plate 6 and the pipe stub 7 are provided with a lateral slit 8 in order to bring the towing cable comfortably into the region of a clamping unit 10 and a tensioning unit 15.

The clamping unit 10 is fitted in the vicinity of the thrust plate 6 on an extension 9 and comprises parallel clamping jaws 11 which are linked to the extension 9 by means of parallel links 12. If the parallel links are moved towards the thrust plate 6, i.e. in the direction of the pipe to be pulled in, the clamping jaws 11 approach one another and are able to clamp the towing cable 4 if it is located between the clamping jaws 11. The greater the force acting on the towing cable 4, the more firmly is the cable clamped by the clamping jaws 11. On one parallel link 12 there is a lever extension 13 which is pulled towards the thrust plate 6 by means of a spring 14. Through a movement of the lever extension 13 away from the thrust plate 6 the clamping of the cable by the clamping jaws 11 can be released. This cable clamping is automatically released if the towing cable 4 is moved in the direction away from the thrust plate 6.

This movement of the towing cable 4 is effected by the tensioning unit 15. The tensioning unit 15 likewise has parallel clamping jaws 16, which are arranged coaxially with the clamping jaws 11 and with the pipe 3 to be pulled in. The clamping jaws 16 are arranged on parallel links 17 which, however, are not pivoted directly on the extension 9 but on a pair of links 18 which are supplemented by a further link 19 to form a link parallelogram. The further link 19 has a lever extension 20 by which the towing cable 4 can be tensioned. For this purpose the towing cable 4 is placed between the clamping jaws 11 of the clamping unit 10 and the clamping jaws 16 of the tensioning unit 15.

By movement of the lever extension 20 away from the thrust plate 6 the cable is pulled through the clamping unit 10, the thrust member 5 and the pipe 3 to be pulled in, and is tensioned. If the tensioning unit 15 is now moved towards the thrust plate 6, the clamping unit 10 holds the towing cable 4 fast and the towing cable 4 can again be tensioned by a renewed movement of the tensioning unit 15 in the direction away from the thrust plate 6. By repeated movements of the tensioning unit 15 any desired pretensioning of the towing cable can be achieved. Similarly, it is possible to increase the pretensioning of the towing cable 4 again should it decrease as the percussion boring machine is driven forwards.

To release the pretension all that is needed is to move the lever extension 13 away from the thrust plate 6 and thereby hold the clamping jaws 16 of the tensioning unit 15 open.

A simple and secure connection of the towing cable 4 to the percussion boring machine 1 or to the sleeve 2 can be effected if the percussion boring machine 1 or the sleeve 2 is provided with a cable groove 21 running round it which is connected to the interior of the sleeve 2 through an opening 22. If the end of the towing cable is passed through the interior of the sleeve 2 and the opening 22, round the peripheral cable groove 21 and back again through the opening 22 into the interior of the sleeve 2, this free end can be connected to the towing cable 4 by means of a tension-proof connection 23, so that the towing cable 4 is securely held on to the percussion boring machine 1 and the sleeve 2 by means of the loop of cable lying in the peripheral cable groove 21.

In order to apply a tightening pretension to the cable connection, a compression spring 24 can be arranged round the parallel regions of the cable between the opening 22 and the tension-proof connection 23.

Instead of connecting the free end of the towing cable directly to the percussion boring machine 1 and the sleeve 2 in the manner described, a length of cable having its ends connected together by means of the tension-proof connection 23 can be used here. The towing cable 4 can then be hung on the tension-proof connection 23.

This method of connection has the advantage that both ends of the cable can be equipped with large cable eyes or the like, since in this case the cable loop can be threaded through the opening 22 without the cable eyes having to be threaded through the small opening 22.

What is claimed is:

1. A securing and tensioning device for a towing cable that is secured to a percussion boring machine and connects a pipe that is to be pulled in to the percussion boring machine, said device comprising:

a thrust member bearing on the free end of the pipe that is to be pulled in;

a clamping unit that is adjacent to the thrust member and clamps when a force acts on the towing cable in the direction of the pipe that is to be pulled in; and a tensioning unit, arranged coaxially with the clamping unit, that clamps when a force acts in the direction of the pipe that is to be pulled in and is movable in the direction opposite to that of the pipe that is to be pulled in.

2. A device according to claim 1, wherein the clamping unit has parallel clamping jaws guided on parallel links and the parallel links are pivoted on an extension of the thrust member.

3. A device according to claim 2, wherein one of the parallel links has a lever extension to release the clamping unit.

4. A device according to claim 1 which also comprises a spring urging the clamping unit in the clamping direction.

5. A device according to claim 1, wherein the tensioning unit has parallel clamping jaws guided on parallel links, said parallel links being pivoted on a further pair of links which at one end are pivoted on the extension of the thrust member and at the other end are connected together by a further link and with which a handle for tensioning the pipe to be puled in engages.

6. A device according to claim 5, wherein the handle consists of a lever extension on said further link connecting said further pair of links.

7. A device according to claim 1, wherein said clamping unit and said tensioning unit each have clamping jaws guided on respective parallel links, the thrust member has a lateral opening for introduction of the towing cable and the clamping jaws of said clamping unit and said tensioning unit are guided at one side on the respective parallel links.

8. A device according to claim 1, wherein at the end of the percussion boring machine there is a sleeve to receive one end of the pipe to be pulled in; the sleeve or the percussion boring machine has running round it a cable groove having an opening therein leading into the interior of the sleeve; the towing cable runs through the pipe to be pulled in and the sleeve, through the opening and in the cable groove, and back again through the opening; and the free end of said cable is connected to the cable in a tension-proof manner.

9. A device according to claim 8, wherein a spring tensioning the cable loop lying in the groove is arranged round parallel regions of the cable between the opening and the tension-proof connection.

10. A securing and tensioning device for a towing cable that is secured at a first end to a percussion boring machine and is adjustably secured along a trailing portion thereof to a pipe that is to be pulled into the percussion boring machine, the pipe having a first end extending in the direction of the percussion boring machine and a second end extending in the direction away from the percussion boring machine, said device comprising:

a securing clamp connected to the second end of the pipe, the securing clamp being adapted to releasably clamp the towing cable in response to force acting on the towing cable in the direction towards the percussion boring machine, to thereby secure the cable to the pipe; and a tensioning clamp arranged coaxially with respect to the securing clamp, the tensioning clamp being adapted to releasably clamp the tensioning cable in response to a force acting on the towing cable in the direction towards the percussion boring machine, said tensioning clamp being operatively associated with said securing clamp and being movable in the direction away from the percussion boring machine.

11. A device according to claim 10 further comprising a thrust member connected to said second end of said pipe, said thrust member comprising an elongate support extending in a direction away from said percussion boring machine.

12. A device according to claim 11 wherein said securing clamp comprises at least two clamping jaws arranged in parallel relationship and being guided on at least two parallel links pivotably connected to said elongate support.

13. A device according to claim 12 further comprising a lever arm associated with at least one of the parallel links and being arranged to move said at least one link guiding said clamping jaws for disengagement of said jaws from said towing cable.

14. A device according to claim 10 further comprising a spring urging said securing clamp into clamping engagement with the towing cable.

15. A device according to claim 11 wherein the tensioning clamp comprises at least two clamping jaws arranged in parallel relationship, said clamping jaws being guided on at least two parallel links of a first linkage, said parallel links of said first linkage being pivotably connected to at least two parallel links of a second linkage, each of said parallel links of said second linkage being pivotably connected at a first end thereof to said support member, said parallel links of said second linkage being connected together at their second ends by a connecting link, and a lever arm connected to said connecting link and being arranged to move said clamping jaws of the tensioning clamp in a direction away from said percussion boring machine whereby said first and second linkages and said connecting link cooperate to maintain said clamping jaws of said tensioning clamp in clamping engagement with said towing cable when said clamping jaws are moved in the direction away from percussion boring machine.

* * * * *

UNITED STATES PATENT AND TRADEMARK OFFICE

CERTIFICATE OF CORRECTION

PATENT NO. : 5,642,786

DATED : July 1, 1997

INVENTOR(S) : Puttmann et al.

It is certified that error appears in the above-identified patent and that said Letters Patent is hereby corrected as shown below:

TITLE PAGE

[56] References Cited

FOREIGN PATENT DOCUMENTS

Line 1, "Austria" should be --Australia--.

Signed and Sealed this

Twenty-fourth Day of November, 1998

Bruce Lehman

BRUCE LEHMAN

*Commissioner of Patents and Trademarks*

*Attest:*

*Attesting Officer*